US005287712A

United States Patent [19]

Sieg

[11] Patent Number: 5,287,712

[45] Date of Patent: Feb. 22, 1994

[54] LOCKING ARRANGEMENT CONSISTING OF KEY AND LOCK CYLINDER

[75] Inventor: Giselher Sieg, Erftstadt, Fed. Rep. of Germany

[73] Assignee: Emhart, Inc., Newark, Del.

[21] Appl. No.: 911,572

[22] Filed: Jul. 10, 1992

[30] Foreign Application Priority Data

Jul. 27, 1991 [DE] Fed. Rep. of Germany ..... 4125017

[51] Int. Cl.[5] ..... E05B 19/02

[52] U.S. Cl. ..... 70/406; 70/409; 70/347

[58] Field of Search ..... 70/406, 407, 409, 420, 70/453, 405, 454, 347

[56] References Cited

U.S. PATENT DOCUMENTS

| | | | |
|---|---|---|---|
| 608,069 | 7/1898 | Noack | 70/453 |
| 1,556,242 | 10/1925 | Murphy | 70/347 |
| 1,804,955 | 5/1931 | Schlumpf | 70/454 |
| 3,499,304 | 3/1970 | Naujoks | 70/406 |
| 4,168,617 | 9/1979 | Prunbauer | 70/406 |
| 4,612,787 | 9/1986 | Prunbauer et al. | 70/409 |
| 4,653,298 | 3/1987 | Tietz | 70/406 |
| 4,735,069 | 4/1988 | Steinbach | 70/420 |
| 5,016,455 | 5/1991 | Hennessy | 70/405 |

FOREIGN PATENT DOCUMENTS

| | | | |
|---|---|---|---|
| 0008310 | 3/1980 | European Pat. Off. | 70/406 |
| 1030727 | 5/1958 | Fed. Rep. of Germany . | |
| 653884 | 5/1963 | Italy | 70/453 |
| 355710 | 8/1961 | Switzerland | 70/406 |

*Primary Examiner*—Peter M. Cuomo
*Assistant Examiner*—Darnell M. Boucher
*Attorney, Agent, or Firm*—J. Bruce Hoofnagle

[57] ABSTRACT

The locking arrangement consists of key a and lock cylinder with a guide cross section provided on the rear of the key shank and with profiled longitudinal ribs arranged on the broad face for entry into associated grooves of the lock cylinder key channel. Transversely to the profiled longitudinal ribs, there are provided wards which issue from one narrow edge of the key shank and, in their depth, follow the unit or multiple of the step jump (x) of the lock cylinder core pins. At least the lower rib flank facing the narrow edge of the key shank is perpendicular to the longitudinal center plane of the key shank and the distance of the lower rib flanks from one another is equal. The lower rib flanks are arranged at a distance from one another corresponding to the unit or integral multiple of the step jump (x) and in such a way that the deepest points of the wards are at the level of the lower rib flanks which externally pass tangentially into convexly shaped curved end faces which run tangentially into the upper rib flanks.

4 Claims, 4 Drawing Sheets

LOCKING ARRANGEMENT CONSISTING OF KEY AND LOCK CYLINDER

BACKGROUND OF THE INVENTION

The present invention relates to a locking arrangement consisting of key and lock cylinder with a guide cross section provided on the rear of the key shank and with profiled longitudinal ribs arranged on the broad face for entry into associated grooves of the lock cylinder key channel. Transversely to the profiled longitudinal ribs, there are provided wards which issue from one key shank narrow edge and, in their depth, follow the unit or multiple of the step jump of the lock cylinder core pins, wherein the lower rib flank facing the key shank narrow edge is perpendicular to the key shank longitudinal center plane and the distance of the lower rib flanks from one another is equal.

DE-AS 1 030 727 discloses a key for lock cylinders wherein the key profile is designed to allow a maximum number of profile variations. The profiled longitudinal ribs have different cross sections. They can be in the form of rectangles or saw teeth. The lower rib flank facing the key shank narrow edge extends perpendicularly to the key shank longitudinal center plane both with a rectangular and a sawtooth-type profile cross section of the longitudinal ribs. The profiled longitudinal ribs may be of interest in locking mechanisms. However, it has been found disadvantageous when machining the notch-like wards on the key shank narrow side that, because of the variable profiled longitudinal ribs and profiled longitudinal grooves, very sharp residual profiles generally remain on the broad sides of the key, on which the key user can injure himself. This can also cause these keys to become caught in jacket and trouser pockets and to tear them when the key is removed.

BRIEF SUMMARY OF THE INVENTION

It is an object of the present invention to provide a locking arrangement consisting of key and lock cylinder such that no very sharp profile residues are present when machining the wards, with wide variation in profiled longitudinal ribs and profiled longitudinal grooves.

This object is achieved with a locking arrangement of the type consisting of key and lock cylinder in which the lower rib flanks are arranged at a distance from one another corresponding to the unit or integral multiple of the step jump and in such a way that the deepest points of the wards are at the level of the lower rib flanks which externally pass tangentially into convexly shaped curved end faces which run tangentially into the upper rib flanks.

A design of this type provides a locking arrangement of the type mentioned comprising a key and a lock cylinder which demonstrates particularly wide variation over profiled longitudinal ribs and profiled longitudinal grooves and increased utility. Owing to the particular regularity of the lower rib flanks with respect to the step jump, the deepest points of the wards are invariably located at the level of the lower rib flanks. It is therefore guaranteed, when machining or milling the notch-like wards, that one or more profiled longitudinal ribs are invariably completely cut away in each ward depth. This ensures that a profiled longitudinal rib is never partially cut, avoiding disadvantageous sharp residual ribs. As the lower rib flanks externally pass tangentially into convexly shaped curved end faces which, in turn, run tangentially into the upper rib flank, the external tangible key broad side face has no disadvantageous sharp edges. If the distance of the lower rib flanks from one another corresponds precisely to the step jump, there is a maximum number of possible wards. In addition, the longitudinal profiled ribs and the interposed profiled longitudinal grooves can be at a different distance from the key longitudinal center plane. A paracentric arrangement of one or more profiled longitudinal grooves is also possible. However, it is always ensured that, when milling the wards, no very sharp residual profiles remain on the key broad sides. If the distance of the lower rib flanks from one another corresponds to an integral multiple of the step jump, the wards should be placed such that their deepest points are located at the level of the lower rib flanks. It will be appreciated that the permutation of the key is therefore reduced.

In a preferred embodiment, the ribs of one broad side of the key are staggered with respect to those on the other broad side. An optimum number of profiled longitudinal ribs is thus possible on the broad sides of the key.

In a particularly preferred embodiment, the upper rib flank is also perpendicular to the longitudinal center plane of the key shank.

BRIEF DESCRIPTION OF THE DRAWINGS

Two embodiments of the invention will be described hereinafter with reference to the drawings, in which.

DETAILED DESCRIPTION OF THE INVENTION

Figure 1:
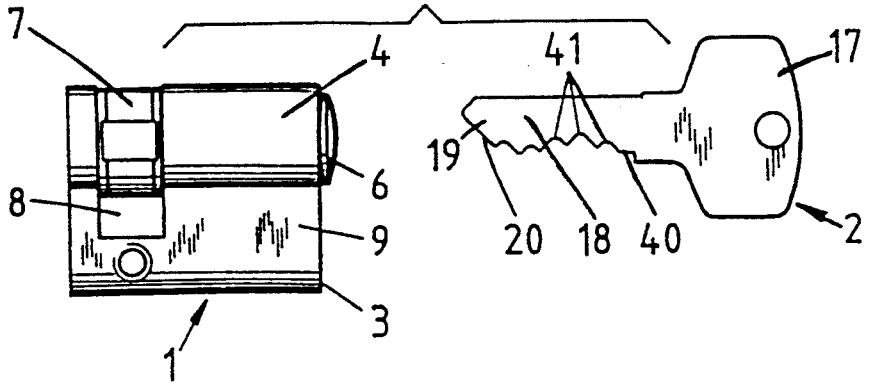
FIG. 1 is a side view of a locking arrangement consisting of key and lock cylinder, substantially in the actual size.
Figure 2:
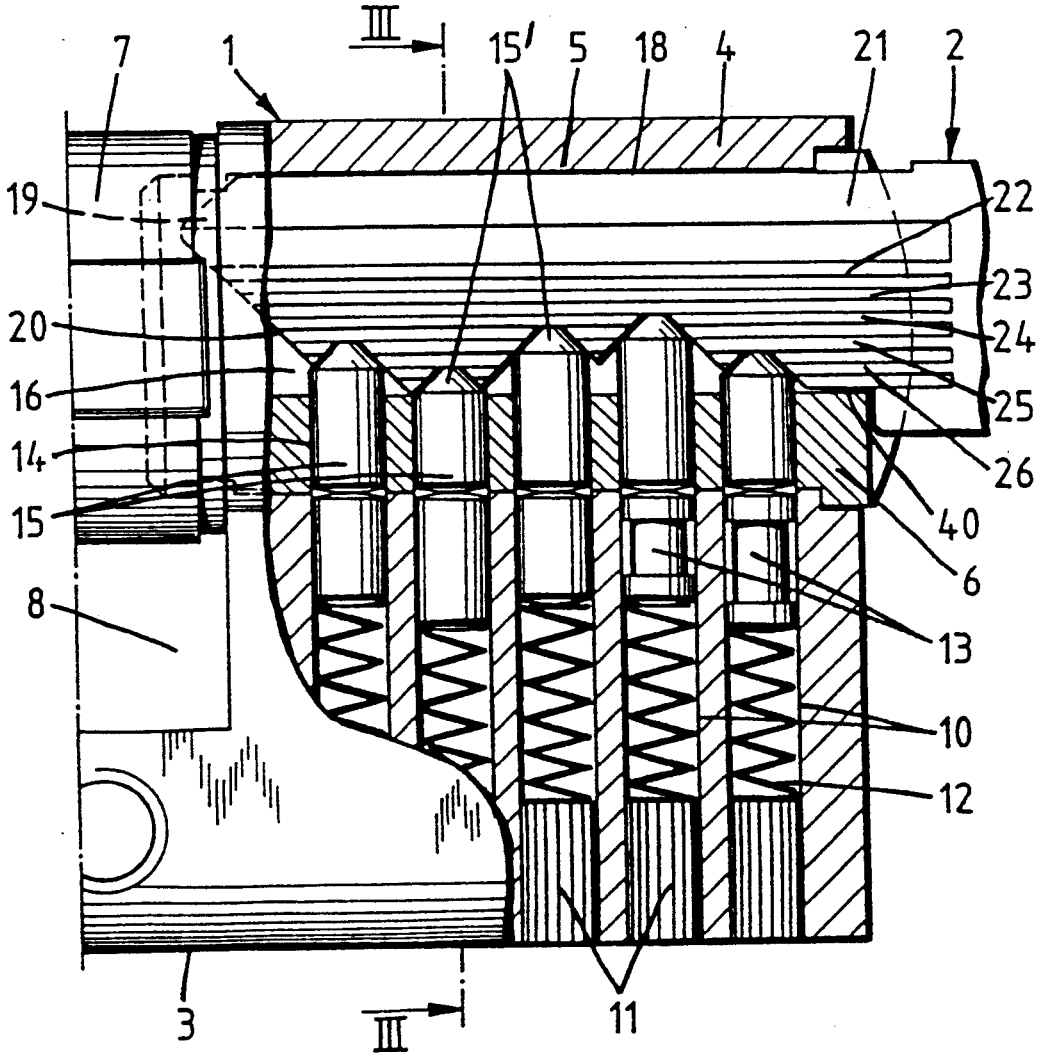
FIG. 2 shows the lock cylinder with inserted key, partly in elevation, partly in a longitudinal section, substantially in a four-fold enlargement.

The locking arrangement is composed of a lock cylinder 1 and a key 2. In the embodiment, the lock cylinder 1 is a profiled half cylinder. The lock cylinder 1 comprises a cylinder housing 3 which, in its upper, substantially circular cylindrical portion 4, comprises a longitudinally extending core bore 5 for mounting of a cylinder core 6. The cylinder core 6 carries a locking element 7 at its inwardly located end. Rotation of the cylinder core 6 is therefore transmitted to the locking element 7. The locking element 7 rests axially immobile in a cutout 8 in the cylinder housing 3.

A flange portion 9 of the cylinder housing 3 extends radially to the circular cylindrical portion 4. Housing bores 10 arranged in succession and extending radially to the cylinder core 6 are provided in this flange portion 9. Their ends remote from the cylinder core 6 are sealed by filling pins 11. The housing bores 10 serve to receive pin springs 12 and housing pins 13 loaded thereby.

Core bores 14, which are orientated radially to the cylinder core 6, for receiving core pins 15 are aligned with the housing bores 10. The housing pins 13 and core pins 15 form tumblers which prevent rotation of the cylinder core 6, and therefore of the locking element 7, when the key 2 is not introduced. The core pins 15 are shifted only by introduction of the appropriate key 2 into a key channel 16 in the cylinder core 6 such that the separating joint between the core pins 15 and the housing pins 13 loaded by them is located at the level of the sliding joint of the cylinder core. The cylinder core 6 is therefore rotatable.

The above-mentioned key channel 16 is cut into the cylinder core 6 from the side of the cylinder core 6 opposite the core bores 14 such that it penetrates the core bores 14 over a proportion of their length.

Figure 3:
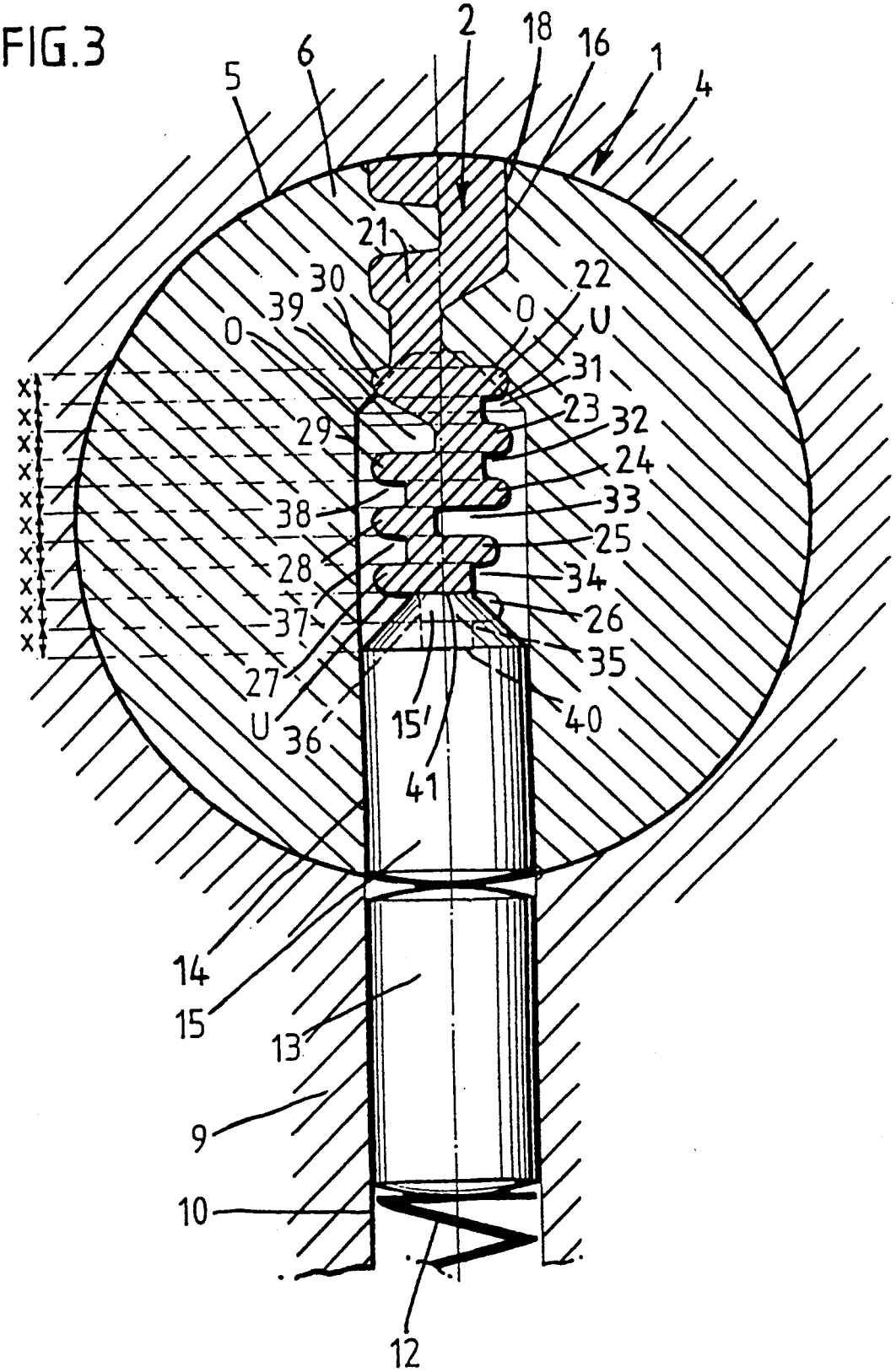
FIG. 3 is the section along line III—III in FIG. 2, but further enlarged.
Figure 4:
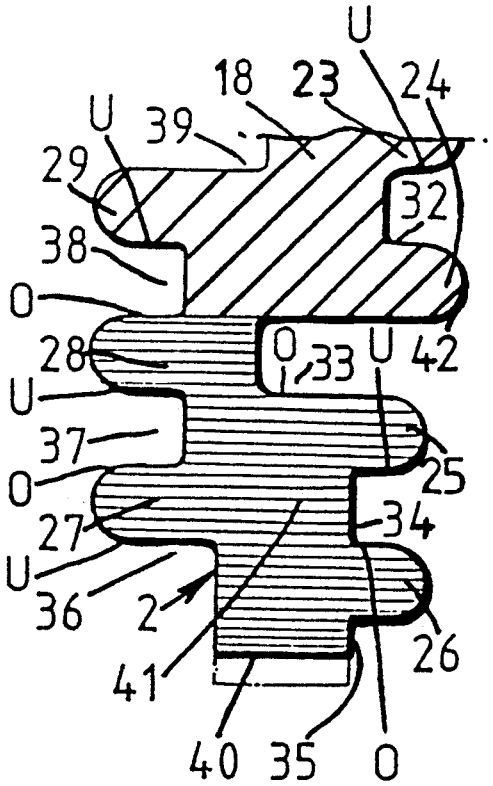
FIG. 4 is a cross section through the key shank at the level of the central ward, further enlarged

The key 2 is in turn designed as a flat key. It comprises a key handle 17 and a key shank 18. The key tip 19 thereof is equipped with a ramp 20 which strikes the ends 15' of the core pins 15, which taper in the manner of a truncated cone, when the key 2 is inserted. The key shank 18 also comprises a guide cross section 21 which is provided on the back and is followed by profiled longitudinal ribs 22–23 arranged on the broad face. The profiled longitudinal ribs 22–30 are formed by profiled longitudinal grooves 31, 32, 33, 34, 35, 36, 37, 38 and 39 machined from the broad sides of the key. As shown in particular in FIGS. 3 and 4, the lower rib flank U facing the narrow edge 40 of the key shank from which there issue notch-like wards 41 for locating the core pins 15, extends perpendicularly to the longitudinal center plane of the key shank. Only the lower rib flank of the top rib 30 extends at an acute angle to the longitudinal center plane of the key shank and forms an exception to the above-mentioned regularity. However, a perpendicular course would also be possible there. FIGS. 3 and 4 also show that the lower rib flanks U arranged at equal distances from one another correspond to the step jump x which the core pins 15 follow. Moreover, the ribs of one broad side of the key are staggered with respect to those of the other broad side. The depth of the profiled longitudinal grooves 31–39 differs. For example, one 33 of these profiled longitudinal grooves can be paracentric in design, i.e. it intersects the longitudinal center plane of the key shank.

FIGS. 3 and 4 show the perpendicular arrangement of the upper rib flanks O with respect to the longitudinal center plane of the key shank. The lower rib flanks U externally pass tangentially into convexly shaped curved end faces 42 which run tangentially into the upper rib flanks O. The correspondingly rounded curved end faces 42 ensure that there are no sharp edges on the broad side of the key.

The wards 41 issuing from the narrow edge 40 of the key shank are then milled sufficiently deeply for their deepest points to be located at the level of the lower rib flanks U. This ensures that a profiled longitudinal rib is never partially cut while machining the wards 41 so as to avoid disadvantageous sharp residual ribs on which the key user could injure himself. The complete faces of the profiled longitudinal ribs which allow optimum locating of the core pins are invariably also available as a run-on face when locating the core pins. In the final phase of the key insertion movement, the core pin ends therefore pass over the region of the wards, this region being formed by the profiled longitudinal ribs adjacent to the deepest points.

The cross section of the key channel 16 is designed according to the cross-sectional profile of the key shank 18. This means that the profiled longitudinal ribs of the key 2 project into corresponding grooves of the key channel 16. The same applies to the profiled longitudinal grooves of the key shank which co-operate with corresponding ribs of the key channel 16.

Moreover, the construction of the profiled longitudinal ribs 22–30 and the associated profiled longitudinal grooves 31–39 allows wide variation so that the design according to the invention can be used desirably in lock mechanisms.

Figure 5:
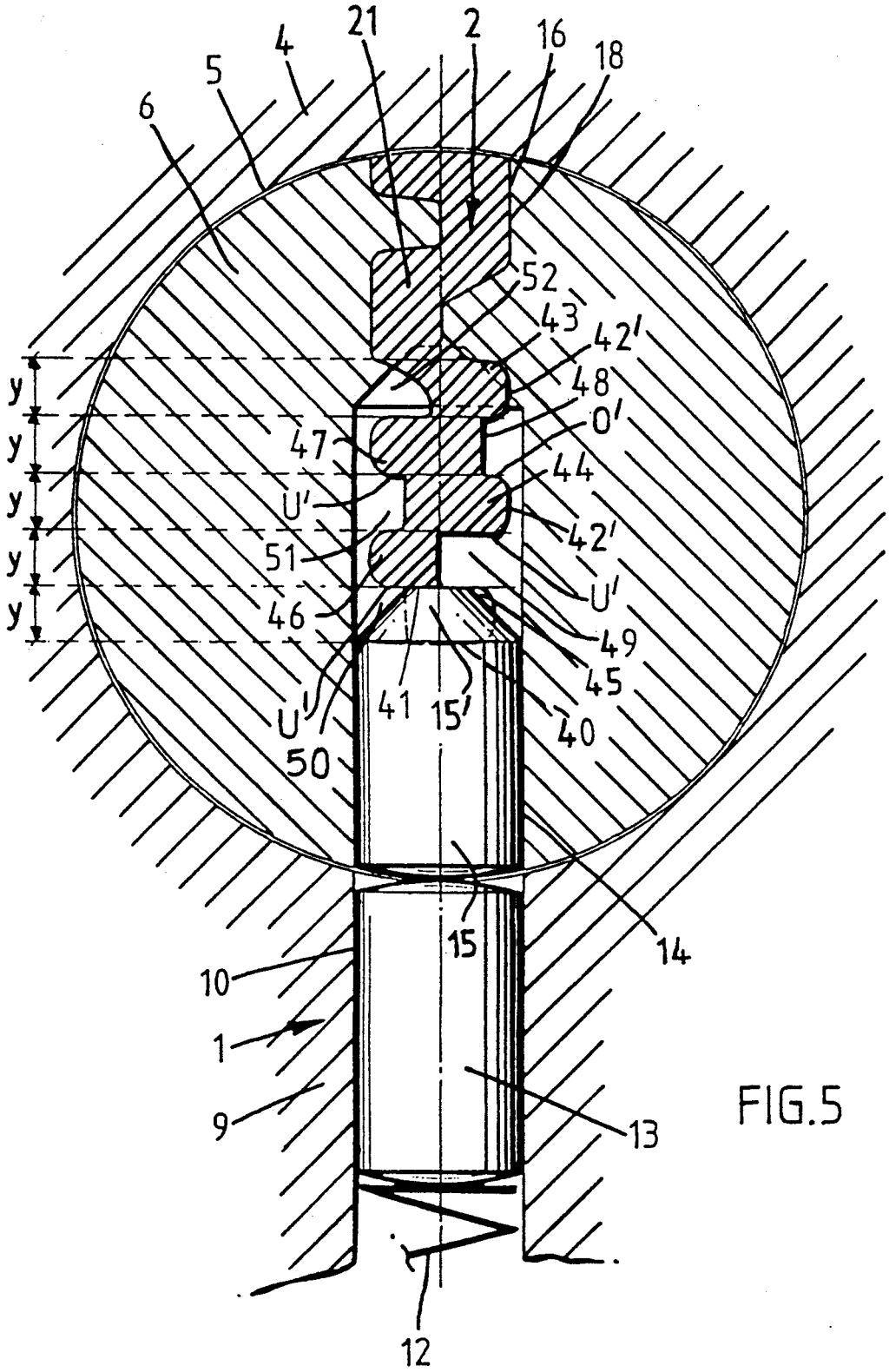
FIG. 5 is a view corresponding to FIG. 3 in which the distance between the lower rib flanks corresponds to twice the step jump.

In the second embodiment, shown in FIG. 5, similar components have similar reference numerals. In contrast to the first embodiment, the distance y between the lower rib flanks U' is twice the step jump x. There is therefore a reduced number of profiled longitudinal ribs 43, 44, 45, 46, 47 and therefore also of associated profiled longitudinal grooves 48, 49, 50, 51 and 52. With this design also, the corresponding lower rib flanks U' extend perpendicular to the longitudinal center plane of the key shank. The lower rib flanks U' also pass externally tangentially into convexly shaped curved end faces 42' which run tangentially into the upper rib flank O' so that there are no sharp-edged profiled edges on the key shank broad faces there either.

As the distance between the lower rib flanks U' corresponds to twice the step jump, the wards 41 are placed such that their deepest points are located at the same level as the lower rib flanks.

I claim:

1. A locking system, which comprises:

a key formed with a key shank having a broad face extending generally along a longitudinal central plane from the rear end thereof toward an opposite end thereof which is opposite the rear end;

a guide cross section formed on the rear end of the key shank;

a plurality of profiled longitudinal ribs formed on the broad face of the key shank extending at least partially between the rear and opposite ends;

a narrow edge formed on the key shank extending at least partially between the rear and opposite ends of the key shank;

a plurality of wards formed in the narrow edge of the key shank transversely to the profiled longitudinal ribs;

each of the plurality of ribs being formed with a lower rib flank and an upper rib flank;

each of the lower rib flanks being perpendicular to the longitudinal central plane;

the lower rib flank of each rib being spaced by a prescribed distance from the lower rib flank of any rib immediately adjacent thereto;

each rib formed with a convexly shaped curved end face which extends tangentially between the lower rib flank and the upper rib flank of the rib;

each of the plurality of wards extending transversely from the narrow edge to the lower rib flank of a respective one of the plurality of profiled longitudinal ribs;

a lock cylinder formed with a key channel having a plurality of grooves arranged to receive the profiled longitudinal ribs; and a plurality of core pins located with the lock cylinder wherein each core pin is arranged to move into a respective one of the wards to the respective lower rib flank associated with the respective one of two wards.

2. The locking system of claim 1 wherein the broad face is a first broad face, which further comprises:

a second broad face formed on a side of the key shank opposite a side thereof on which the first broad face is formed, and profiled longitudinal ribs formed on the second broad face which are staggered with respect to the profiled longitudinal ribs formed on the first broad face.

3. The locking system of claim 1 wherein the upper rib flank is perpendicular to the longitudinal central plane.

4. The locking system of claim 2 wherein the upper flank is perpendicular to the longitudinal central plane.

* * * * *

UNITED STATES PATENT AND TRADEMARK OFFICE

CERTIFICATE OF CORRECTION

PATENT NO. : 5,287,712

DATED : February 22, 1994

INVENTOR(S) : Giselher Sieg

It is certified that error appears in the above-indentified patent and that said Letters Patent is hereby corrected as shown below:

On the title page, the Assignee should apear as follows:

DOM-Sicherheitstechnik GmbH & Co KG

Signed and Sealed this

Second Day of May, 1995

*Attest:*

Bruce Lehman

BRUCE LEHMAN

*Attesting Officer*

*Commissioner of Patents and Trademarks*